US005355050A

United States Patent [19]

Sluyterman

[11] Patent Number: 5,355,050

[45] Date of Patent: Oct. 11, 1994

[54] COLOR DISPLAY TUBE WITH COMA CORRECTION

[75] Inventor: Albertus A. S. Sluyterman, Eindhoven, Netherlands

[73] Assignee: U.S. Philips Corporation, New York, N.Y.

[21] Appl. No.: 891,368

[22] Filed: May 29, 1992

[30] Foreign Application Priority Data

Jun. 5, 1991 [EP] European Pat. Off. ..... 91201380.2

[51] Int. Cl.[5] ..... H01J 29/54; H01J 29/58

[52] U.S. Cl. ..... 313/440; 313/413

[58] Field of Search ..... 313/440, 413, 431

[56] References Cited

U.S. PATENT DOCUMENTS

| | | | |
|---|---|---|---|
| 4,196,370 | 4/1980 | Hughes | 313/413 |
| 4,455,542 | 6/1984 | Sluijterman et al. | 313/428 |
| 4,524,340 | 6/1985 | Sluyterman | 335/212 |
| 4,600,858 | 7/1986 | Iwasaki et al. | 313/413 |
| 4,710,671 | 12/1987 | Sluyterman | 313/413 |
| 4,874,983 | 10/1989 | Sluyterman | 313/440 |
| 4,962,333 | 10/1990 | Sluyterman | 313/440 |

FOREIGN PATENT DOCUMENTS

| | | | |
|---|---|---|---|
| 0241057 | 10/1987 | European Pat. Off. . | |
| 2267840 | 11/1990 | Japan | 313/440 |

*Primary Examiner*—Sandra L. O'Shea
*Attorney, Agent, or Firm*—Robert J. Kraus

[57] ABSTRACT

Color display tube comprising an electron gun system (5) of the "in-line" type and an electromagnetic deflection unit. This unit is provided with coma correctors 14 and 14' at its gun side, which correctors, viewed from the gun system, provide a pincushion-shaped vertical deflection field component and a barrel-shaped vertical deflection field component. These components are used to reduce the "green droop" (=anisotropic Y coma) in the corners and at the ends of the display screen axes to an equal extent without the spot shape of the outer beams being influenced detrimentally.

6 Claims, 4 Drawing Sheets

COLOR DISPLAY TUBE WITH COMA CORRECTION

BACKGROUND OF THE INVENTION

The invention relates to a colour display tube comprising an electron gun of the "in-line" type for generating three electron beams whose axes are coplanar, a deflection unit comprising a first and a second deflection rail for generating a first and a second deflection field for deflecting the electron beams in the operating display tube across said display screen in two mutually perpendicular directions, the direction of the first deflection field being parallel to said plane, and convergence correction means which, during deflection, keep the electron beams converged on a display screen arranged on a wall of the envelope and having a short display screen axis and a long display screen axis.

Various types of deflection units may be used for deflecting the electron beams in colour display tubes. In tubes having an "in-line" electron gun system these deflection units are generally self-convergent. In conventional deflection units having line deflection coils of the saddle type and field deflection coils of the toroidal type the winding technique used does not permit of rendering the unit entirely self-convergent. Usually such a winding distribution is chosen that a certain convergence error remains, which error is commonly referred to as coma. This coma error becomes manifest, for example, in a larger raster (horizontal and vertical) for the outer beams with respect to the central beam. The horizontal and vertical deflection of the central beam is smaller than that of the outer beams. As described, inter alia, in U.S. Pat. No. 4,196,370, this can be corrected by providing elements (referred to as field shapers) of a material (for example of mu-metal) having a high magnetic permeability around the outer beams at the end of the gun. The peripheral field at the area of the outer electron beams is shielded to some extent by these elements, so that these beams are deflected to a lesser extent and the coma error is reduced.

Various problems then present themselves. A first problem is that the shielding means around the outer electron beams detrimentally influence the spot shape of these beams. Another problem is that the correction of the field coma (Y coma) is anisotropic. In other words, the correction in the corners is less than the correction at the end of the field axis (the field axis is the display screen axis which is parallel to the field deflection direction). This is caused by the positive "lens" action of the line deflection coil (approximately quadratically with the line deflection) for vertical beam displacements. (The field deflection coil has a corresponding lens action, but it does not contribute to the relevant anisotropic effect.)

SUMMARY OF THE INVENTION

It is, inter alia, an object of the invention to provide a solution to the above-mentioned problems. To this end, a colour display tube of the type described in the opening paragraph is characterized in that the convergence correction means effects a first, or field deflection field which is characterized in that an electron beam entering the field deflection field first passes an area with a barrel-shaped deflection field component and next an adjoining area with a pincushion-shaped deflection field component.

Such a distribution of field components, whose effect will be elucidated, may be realised in different manners. If the strength of the barrel-shaped field component is to be adjusted independently of the strength of the pincushion-shaped field component, it will be, for example advantageous to use an embodiment which is characterized in that convergence correction means comprise a first coma corrector which is positioned at the gun side of the first deflection coil and provides the pincushion-shaped field component, and a second coma corrector which, viewed in the direction of propagation of electrons, is positioned upstream of the first coma corrector and provides the barrelshaped field component.

The invention is based, inter alia, on the recognition that the problem of the anisotropic Y coma (referred to as "green droop") can be reduced by making suitable use of the Z dependence of the anisotropic Y coma.

This dependence implies that as the coma correction takes place at a larger distance (in the Z direction) from the "lens" formed by the line deflection coil, the action of said "lens" becomes more effective so that the coma correction acquires a stronger anisotropic character. The invention utilizes this aspect in that a pincushion-shaped component is realised at the entrance side of the field deflection field, so that coma is corrected, and in that barrel-shaped component is realised upstream of said area, so that the anisotropic character of the correction will be less anisotropic.

Field coma errors at the end of the vertical axis and in the comers can be corrected effectively and to an approximately equal extent by effecting particularly a pincushion-shaped component which has a strength which is sufficient to correct the field coma in the comers, but which is more pincushion-shaped than is necessary for coma correction at the ends of the vertical axis, and by effecting a barrel-shaped vertical deflection field component at a location located closer to the electron gun or around the electron gun, which field component corrects the overcompensation at the ends of the vertical axis.

By influencing the shape of the deflection field, rather than partly shielding the side beams from the deflection field, it is achieved that the spots of the side beams are not influenced detrimentally. An additional advantage is that the deflection unit can be moved in the axial direction, for example, for colour purity adjustment without this influencing the convergence.

The display tube according to the invention is very suitable for use with a field deflection coil of the toroidal type, particularly when the display tube should be free from raster correction.

BRIEF DESCRIPTION OF THE DRAWING

These and other aspects of the invention will be elucidated with reference to the embodiments described hereinafter.

DESCRIPTION OF THE PREFERRED EMBODIMENTS

Figure 1:
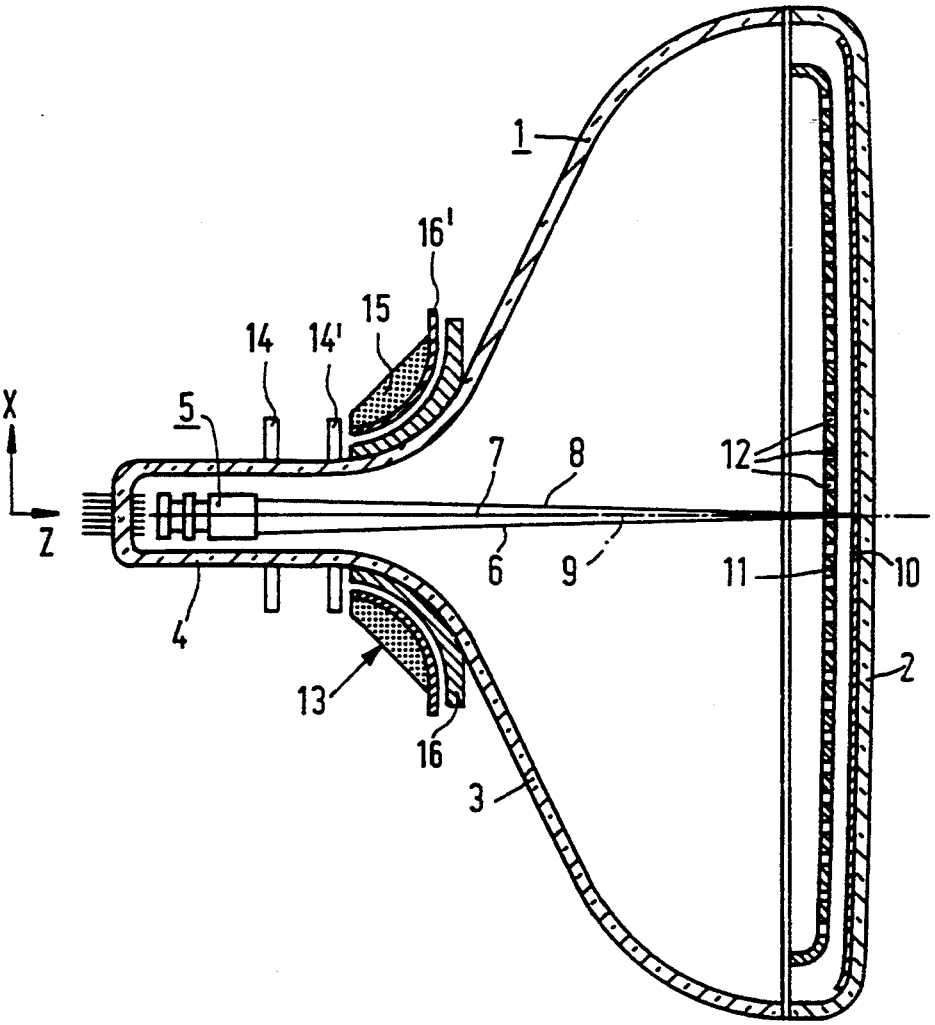
FIG. 1 is a longitudinal section of a display tube according to the invention with field coma correctors 14 and 14'.

FIG. 1 is a longitudinal section of a display tube according to the invention. It is a colour display tube of the "in-line" type. In a glass envelope 1, which is composed of a display window 2, a cone 3 and a neck 4, said neck accommodates an integrated electron gun system 5 which generates three electron beams 6, 7 and 8 whose axes are coplanar prior to deflection. The axis of the central ("green") electron beam 7 coincides with the tube axis 9. The display window 2 has a large number of phosphor element triplets on its inner side. The elements may be rows or dots. Each triplet comprises an element of a blue-luminescing phosphor, an element of a green-luminescing phosphor and an element of a red-luminescing phosphor. All triplets combined constitute the display screen 10. The phosphor rows are substantially perpendicular to said plane through the beam axes. A shadow mask 11 having a very large number of elongate apertures 12 for passing the electron beams 6, 7 and 8 each impinging upon phosphor elements of one colour only is arranged in front of the display screen. The three coplanar electron beams are deflected by a system 13 of deflection coils, which is not completely self converging because of the fact that a field coma error occurs, which system comprises a line deflection coil 16, a yoke ring 15 and a field deflection coil 16'.

Coma correction coil 14' produces a (positive) six-pole field by which a pincushion-shaped field distribution is effected so that the green beam is deflected in the direction of deflection of the field deflection coil to a greater extent than the side beams. Correction coil 14 produces a (negative) six-pole field by which a barrel-shaped field distribution is effected, so that the green beam is deflected in the direction of deflection of the vertical deflection coil to a lesser extent than the side beams.

Figure 2:
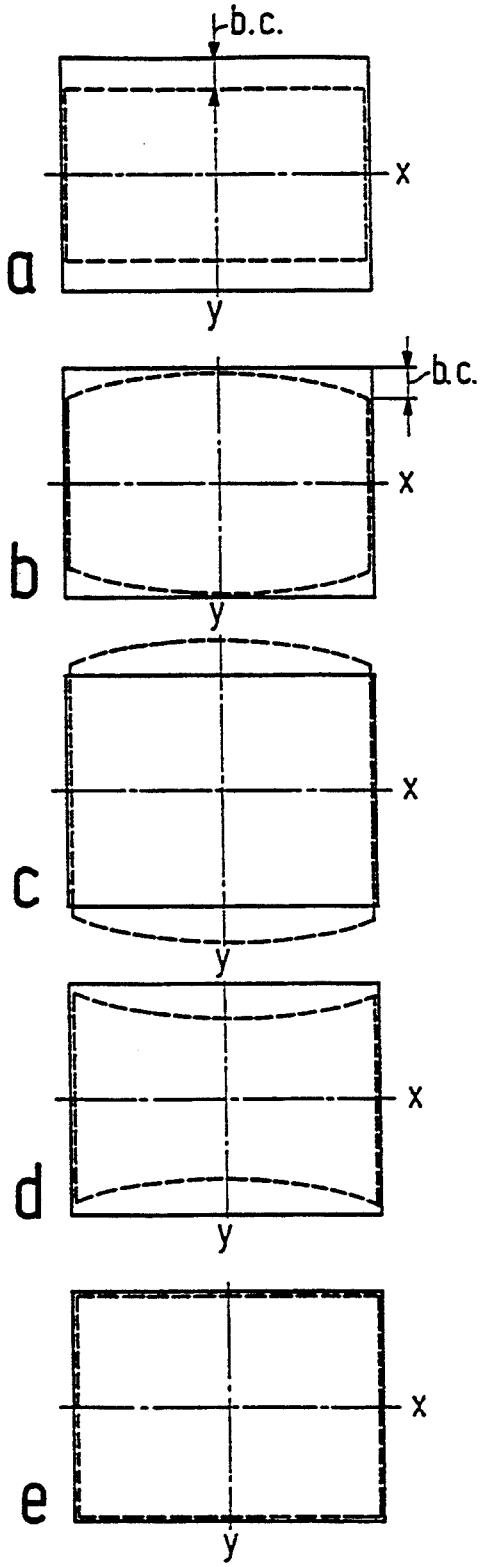
FIG. 2*a* shows the field coma in a conventional display system without coma correction.
FIG. 2*b* shows the field coma in a conventional display system with coma correction.
FIG. 2*c* shows the field coma in a display system according to the invention with coma corrector 14' only.
FIG. 2*d* shows the field coma in a display system according to the invention with coma corrector 14 only.
FIG. 2*e* shows the field coma in a display system according to the invention with complete coma correction.

A problem to be solved is that of the "green droop". Green droop means that the field coma is corrected at the end of the vertical axis but is insufficiently corrected in the comers. FIG. 2*a* shows a situation where the field coma correction is insufficient, FIG. 2*b* shows the green droop situation. This problem becomes worse as the axial distance between the location of coma correction and the centre of the line deflection coil increases. Use can be made of the axial dependence of the green droop for solving the problem of the green droop. The problem can be solved by overcorrecting the field coma at the entrance side of the field deflection field (see FIG. 2*c*) and by performing an opposite correction at a location "upstream" (see FIG. 2*d*), which opposite correction is, however less effective in the comers. The overall result is a uniform coma correction along the entire edge of the display green (see FIG. 2*e*). This idea, using shielding means ("correction rings") is described in U.S. Pat. No. 4,710,671 (European Patent Application no. 205222).

The method described in this Application is based on coma correction by means of field-shielding components arranged around the paths of individual electron beams. The drawback of coma correction by partially shielding the beams is that the spot shape of the side beams is detrimentally influenced.

The invention provides, inter alia, a solution for correcting field coma and preventing the green droop, while the spot shape of the side beames is minimally influenced. Moreover, in the proposed solution the deflection unit can be moved in the axial direction, for example, for colour purity adjustment without any convergence side effects.

Figure 3:
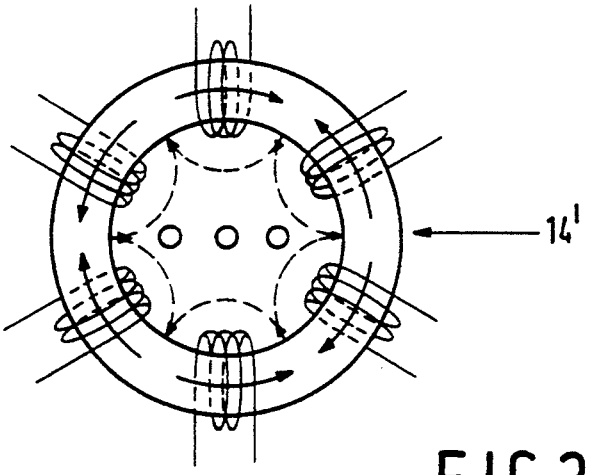
FIGS. 3, 4, 5 show three examples of embodiments of coma correctors for a colour display tube according to the invention.
Figure 4:
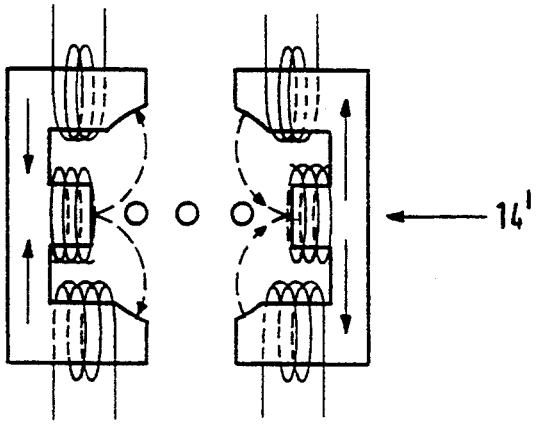
Figure 5:
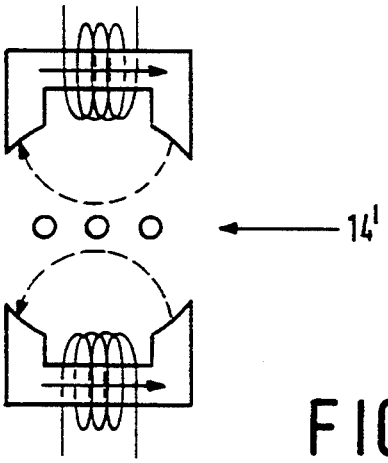

FIG. 3, 4 and 5 show modifications of embodiments of coma correctors 14' each comprising one or more magnetic cores with such a coil arrangement that a positive six-pole field is generated upon energization. FIGS. 3, 4 and 5 show, in this order, increasingly simplified embodiments (i.e. magnetic cores provided with fewer coils). The (overcompensated) coma correction can also be performed by means of coma correction means of the type used in the Philips colour display tube systems 30AX, 45AX or as described in (U.S. Pat. No. 4,524,340) or (U.S. Pat. No. 4,874,983).

The corrector 14 which works in the opposite way and this enlarges the original coma error to some extent may comprise correctors of the type shown in FIGS. 3, 4 and 5, with such an energization of the coils that the field direction is opposite to that shown in FIGS. 3, 4 and 5. This means that a negative sixpole field is generated.

Figure 6A:
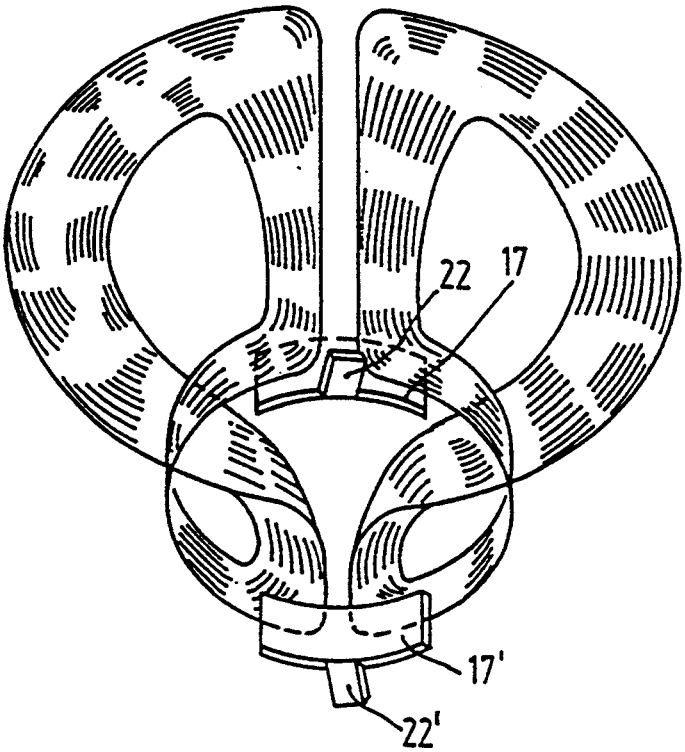
FIGS. 6*a*, 6*b* and FIG. 7 show two modifications of coma correction elements which can be used within the scope of the invention.
Figure 6B:
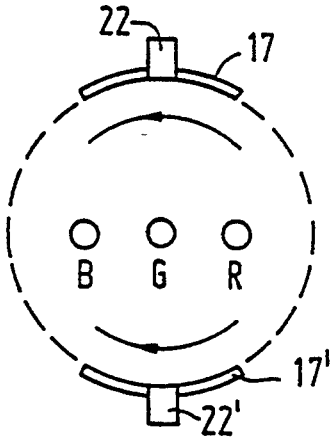

It is alternatively possible to generate a negative six-pole field by arranging two plate-shaped magnetic elements 17, 17' at the gun-sided end of the field deflection coil in the way as shown in FIGS. 6*a* and 6*b*. This construction resembles an astigmatic error corrector, but is arranged at the gun side of the deflection coil. The difference with an astigmatic error corrector is that there is not yet sufficient predeflection, so that there is no or little effect on astigmatism. Viewed in the direction of the screen, the elements 17, 17' will be followed by the conventional astigmatic error correction means.

Figure 7:
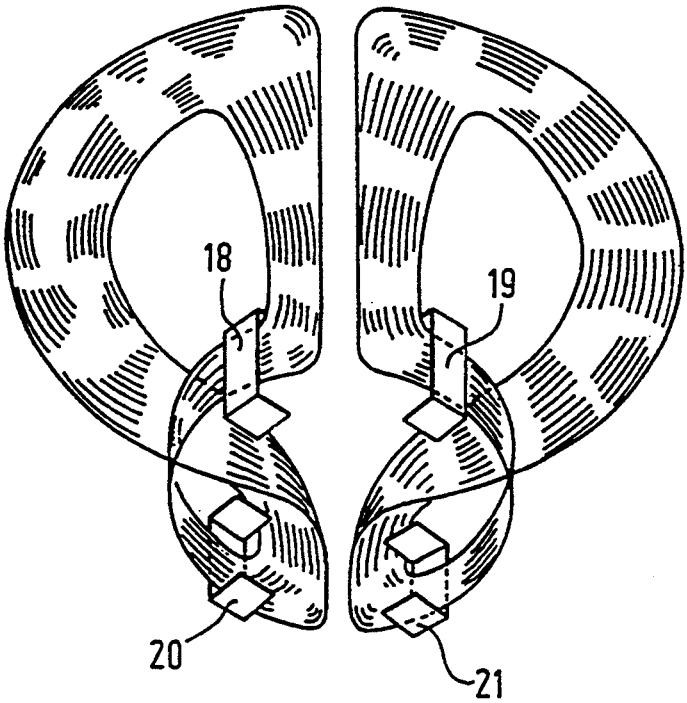

When using a saddle-shaped or mussel-shaped field deflection coil it is possible to perform the same effect as the correction means 14 and 14' by arranging four U-shaped correctors 18, 19, 20, 21 in the manner shown in FIG. 7. A field similar to that of FIG. 5 is then produced at the screen side of the U-shaped correctors and a field opposite thereto is produced at the gun side. The extent to which the limbs of the U-shaped correctors extend towards as the neck glass determines the strength of the correction.

I claim:

1. A color display tube comprising:

(a) a display screen having a short display screen axis and a long display screen axis, (b) an electron gun for generating three electron beams whose axes are coplanar, (c) a deflection unit comprising a first and a second deflection coil for generating a first and a second deflection field for deflecting the electron beams across said display screen in two mutually perpendicular directions, the direction of the first deflection field being parallel to said beam axes plane, (d) convergence correction means for, during deflection of the beams, keeping the electron beams converged on the display screen, said convergence correction means providing a field deflection field positioned with respect to the beams such that the electron beams entering the field deflection field first pass an area with a barrel-shaped deflection field component and next pass an area with a pin-cushion-shaped deflection field component.

2. A colour display tube comprising:

(a) a display screen having a short display screen axis and a long display screen axis, (b) an electron gun for generating three electron beams whose axes are coplanar, (c) a deflection unit comprising a first and a second deflection coil for generating a first and second deflection field for deflecting the electron beams across said display screen in two mutually perpendicular directions, the direction of the first deflection field being parallel to said beam axes plane, (d) convergence correction means for, during deflection of the beams, keeping the electron beams converged on the display screen, said convergence correction means comprising:

(i) a first coma corrector positioned at the gun side of the first deflection coil and providing a pin-cushion-shaped field component, (ii) a second coma corrector positioned at the gun side of the first deflection coil and upstream of the first coma corrector, when viewed in the direction of propagation of the electron beams, and providing a barrel-shaped field component.

3. A colour display tube as claimed in claim 2, characterized in that the first coma corrector overcompensates coma at the end of the short display screen axis and in that the second coma corrector corrects the overcompensation produced by the first coma corrector.

4. A colour display tube as claimed in claim 2, characterized in that the first coma corrector comprises a system of coils wound on at least one magnetic core, which system, when energized, generates a magnetic six-pole field.

5. A colour display tube as claimed in claim 2, characterized in that the second coma corrector comprises a system of coils wound on at least one magnetic core, which system, when energized, generates a magnetic six-pole field.

6. A colour display tube as claimed in claim 2, characterized in that at least one of the coma correctors comprises at least two plate-shaped magnetic elements arranged in the first deflection field so as to realise a six-pole field component.

* * * * *